United States Patent [19]

Marega

[11] Patent Number: 4,951,364

[45] Date of Patent: Aug. 28, 1990

[54] LOCKING LEVER FOR SKI BOOTS

[75] Inventor: Antonello Marega, Montebelluna, Italy

[73] Assignee: Calzaturificio Tecnica SpA, Treviso, Italy

[21] Appl. No.: 375,486

[22] Filed: Jul. 5, 1989

[30] Foreign Application Priority Data

Jul. 5, 1988 [IT] Italy ..... 21551 B/88

[51] Int. Cl.[5] ..... A43C 11/14

[52] U.S. Cl. ..... 24/68 SK; 24/70 SK

[58] Field of Search ..... 24/68 SK, 69 SK, 70 SK, 24/71 SK; 36/50

[56] References Cited

U.S. PATENT DOCUMENTS

| | | | |
|---|---|---|---|
| 3,546,751 | 12/1970 | Baso | 24/70 SK |
| 4,051,611 | 10/1977 | Chalmers | 24/68 SK X |
| 4,796,337 | 1/1989 | Marxer | 24/68 SK |

FOREIGN PATENT DOCUMENTS

| | | | |
|---|---|---|---|
| 140874 | 5/1985 | European Pat. Off. | 36/50 |
| 3222383 | 1/1983 | Fed. Rep. of Germany | 24/69 SK |

*Primary Examiner*—James R. Brittain

*Attorney, Agent, or Firm*—Griffin, Branigan & Butler

[57] ABSTRACT

The closing and locking lever for ski boots is manufactured from shaped metal covered along the whole sides and the edges by a protecting material, such as rubber or plastic material.

8 Claims, 2 Drawing Sheets

LOCKING LEVER FOR SKI BOOTS

The present invention relates to the closing and locking levers for a ski boot.

Upon reconsidering the history and the development of the ski boots throughout the last thirty years it can be observed that one of the important elements has been and is the closing and locking lever.

When, during the sixties, the ski boots were manufactured from leather and it was appreciated that, for a good performance of the ski boot, it was advisable to provide as close a fit as possible between the ski boot and the foot of the skier, and such fit was practically provided mostly by the closing and locking levers of the upper. Models of ski boots were popular having a high number of closing and locking levers, the latter having a structure such as to permit a fine and differentiated adjustment of the locking force.

These levers were manufactured from a metal material providing the necessary strength properties even at the low temperatures at which normally the ski boots are used.

One drawback was and is the poor resistance to the scratching of the surface painting even if, obtained with the latest technologies and materials.

Once the ski boots manufactured by moulding in plastic material appeared, the closing and locking levers were reduced in number and were also modified as to their structure and manufacturing materials. More particularly closing and locking levers were manufactured from plastic material.

This fact on the one hand lead to advantages from the point of view of the industrial production and of the related costs, it involving however some drawbacks and problems.

Firstly the lower strength of the plastic materials, with respect to the metal has imposed a limit to the cross section sizes of the levers, in the sense that they could not be reduced under certain limits which are relevantly higher than those of metal levers, the properties and performances being alike.

Secondly the plastic material can be more easy chipped whereby in a short time the ski boot is degraded from aesthetical point of view and moreover it is not possible to avoid shocks and hits of the boots and consequently of the levers.

The main purpose of the present invention is that of solving the above shortly mentioned problems and drawbacks in an industrially advantageous manner.

To this end, according to the present invention there is provided a closing and locking lever characterized in that the body of the lever components is manufactured from metal material, whereas at least the sides and preferably both the sides and all other parts of the levers subjected to damage owing to hit or other cause are protected by a covering of a material selected among plastic materials and resilient materials.

In this way the above defined purpose is fully achieved and particularly:

(a) the size of the lever body can be reduced, the strength being the same;

(b) the covering of plastic material can be selected as a function of the requested property without having to fulfill other, sometime opposite requisites such as the structure strength.

More particularly it is possible to use a covering of rubber providing the maximum protection, which to date has not been possible to use for the structural parts of the levers, owing to the self-evident reasons;

(c) it is possible to replace the rubber or plastic material protection, safeguarding the lever structure, with the self-evident advantage for the user.

These features and advantages shall appear still more clearly from the following detailed description of a preferred embodiment with reference to the accompanying drawings, wherein.

Figure 2:
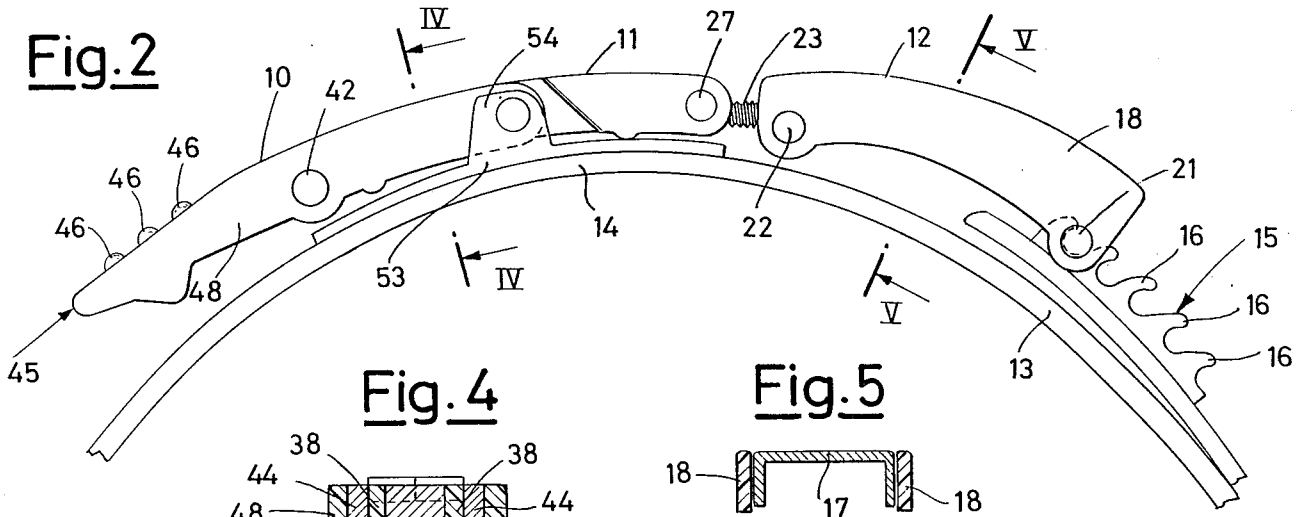
FIG. 2 is a side view of the lever of FIG. 1 shown in the operating position.
Figure 5:
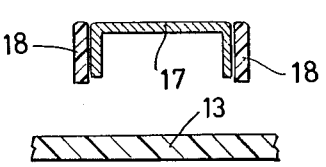
FIGS. 4 and 5 are cross-section views according to the lines IV—IV and V—V of FIG. 2.
Figure 4:
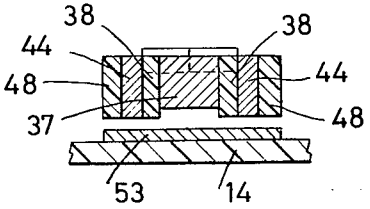

Turning now to the drawings, the lever according to the present invention comprises a first actuating arm 10, a second articulation arm 11 and a third hooking arm 12. Those three arms are per se of conventional structure and functions as it is shown in FIG. 2, in which the lever of the invention is shown in the application to a ski boot, in which an edge 13 must be closed and locked with respect to a portion 14.

The edge 13 is provided with the usual adjustable hooking member 15 having a number of positions individuated by the inclined ribs 16. The third hooking arm consists of an U shaped metal section 17 provided at both sides with protection shaped parts 18 of plastic material. The latter are fastened to the sides of the section 17 by suitable means for example by cementing.

Both the section 17 and the protecting shaped parts 18 have coaxial holes 19 and 20 for the introduction of the pins 21 and 22 respectively for the hooking and for the mounting of a sleeve (not shown and of traditional type) having a screw 23 for the fine adjustment of the lever length.

Figure 3:
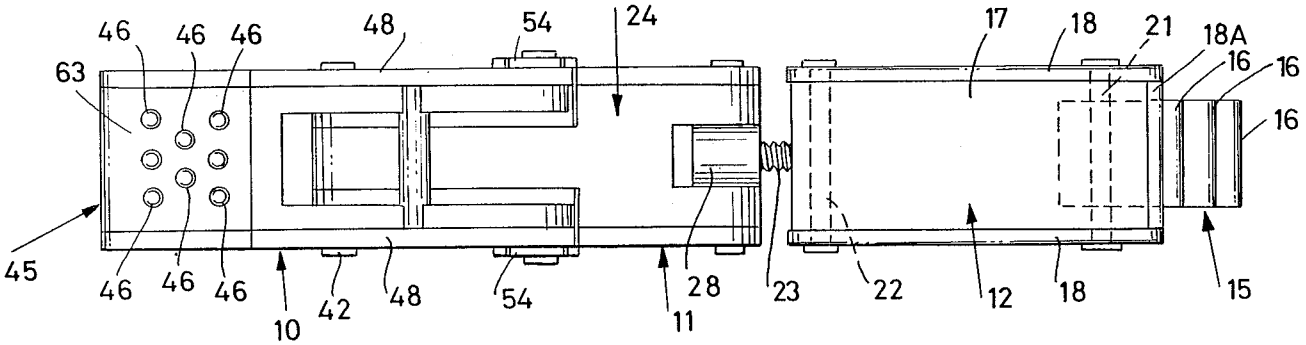
FIG. 3 is a plan view from above of the lever.

From the FIG. 3 it is moreover observed that a further shaped part 18A of plastic material is provided for the protection of the end of the section 17.

Figure 1:
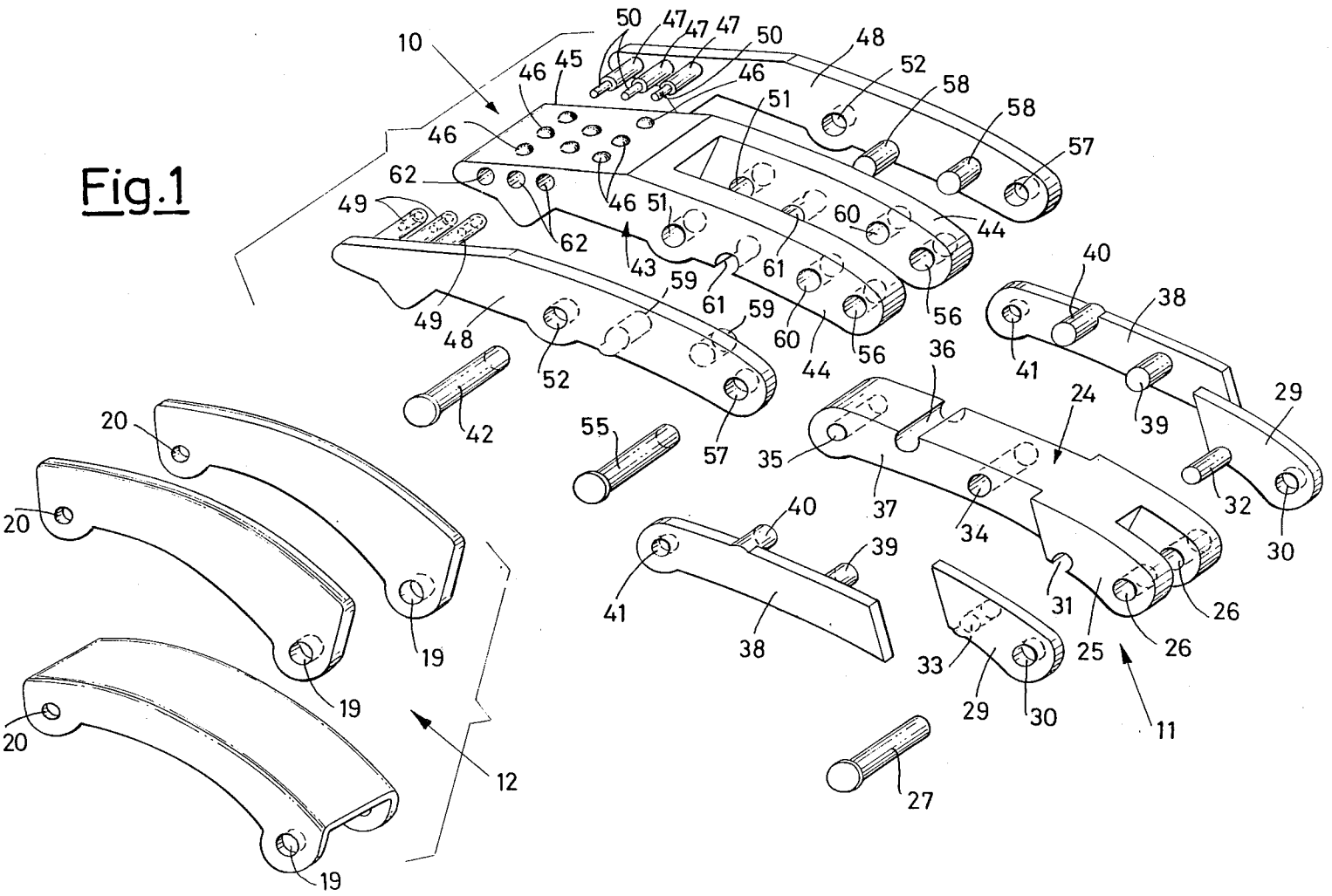
FIG. 1 is an exploded perspective view of the closing and locking lever according to the invention.

Turning now to the second arm 11, it comprises a metal bridge element 24 shaped, as shown in FIG. 1, with a fore enlarged head 25, having holes 26 for the introduction of a pin 27, to which a barrel 28 is mounted, having the free end of the screw 23 engaged therewith so as to be able to be screwed and unscrewed.

To the sides of the head 25 the protection shaped parts of plastic material 29 are fastened, having holes 30 for receiving the pin 27. For the tight coupling between the sides as protection plastic material 29 and the head 25, the latter is provided with a groove 31 in which the pin 32 is seated, it being engageable with the hole 33 formed in the opposite side of protection plastic material 29.

The rear part 37 of the bridge element 24 has the holes 34 and 35, as well as the groove 36.

Also the rear part 37 is protected at its sides by the plastic material shaped parts 38 having pins 39, engaging the hole 34, the pins 40 engaging the groove 36 and engaged to each other in a forced manner, and holes 41 coaxial with the holes 35 and receiving the articulation pin 42 for the hereinafter indicated purpose.

Coming now to considering of the first arm 10, it comprises a central metal lever 43 shaped as fork with two arms 44, between which the part 37 of the second arm 11 is inserted for the coupling.

The lever 43 ends with a tail part 45, it being too protected by a shaped part 63 of plastic material and having means to make it easier the handling which in the shown embodiment consist of protrusions 46, whereas in the body of the tail part 45 holes 62 are provided forming the seat of rollers 47 formed on either of the two sides of plastic material 48, whereas the other one has axially perforated protrusions 49 in which the reduced diameter ends 50 of the rollers 47 are engaged to complete the rollers themselves.

The lever 43 is provided with through holes 51 which in the mounting are aligned with the holes 35 of the arm 11 and with the holes 41 of the sides of plastic material shaped part 38, whereby the end of the bridge element 24 is journalled to the lever 43 by the pin 42. The sides of plastic material 48 are likewise anchored to the pin 42 through the coaxial holes 52.

For the anchoring of the lever 43 to the portion 14, the latter is provided with a support 53, supporting two brackets 54 in which a pin 55 is housed, by which the end of the lever 43 is rotatably secured, passing within the holes 56 of the arms 44 and within the coaxial holes 57 of the sides of plastic material 48. Lastly the securing of the shaped parts or said of plastic material 48 to the lever 43 is completed by the coupling between the pins 58 protruding from one of the sides of plastic material 48 and the blind holes 59 formed in the opposite side of plastic material 48, said pins being housed in the through holes 60 and in the groove 61 provided in the arms 44.

From the above description the structure of the closing and locking lever according to the invention is evident.

More particularly it can be realized that the lever itself is protected in all the parts subjected to hits by shaped parts of suitable material, either plastic or resilient, the shaped parts being moreover easily replaceable.

Under this point of view, instead of rivets, self screwing screws can be used, especially for the pins 22 and 27 which are engaged with the barrels for the mounting of the adjustment screw 23.

It is evident that modifications and variations, conceptually and structurally equivalent, are possible and foreseeable.

The structure of the lever can be different, for instance according to other types already known and used, provided that the structure itself is manufactured from metal, for example anodized aluminium, and the sides are covered and protected by plastic material or rubber shaped parts.

I claim:

1. In a closing and locking lever for ski boots having a first actuatable arm pivotably connected at near a first end thereof to one portion of a ski boot upper and a second end thereof is configured for manual gripping and actuation thereof, a second actuatable arm hingably attached at a first end thereof to the first end of first arm, and a hook arm adjustably and hingably attached at a first end thereof to a second end of the second arm, and said hook arm having at a second end thereof a laterally disposed pin for engaging an upstanding rib of a hooking member attached to another portion of the ski boot upper, and wherein each of said arms have opposed side surfaces and top surfaces, the improvement wherein at least each of the opposed side surfaces of the first and second arms have a replaceable, preformed and preshaped plastic or rubber protection material detachably disposed thereon, and wherein the protection material covers substantially all of said opposed side surfaces of the first and second arms.

2. The lever of claim 1 wherein the said protection material is detachably held to said side surfaces by removable pins passing through apertures in said protection material and engagable with and retainable in apertures in said arms.

3. The lever of claim 1 wherein the said protection material is detachably held to said side surfaces by pins which are integral with and part of the protection material, said pins being engagable with and retainable in apertures in said arms.

4. The lever of claim 1 wherein the said protection material on one of said side surfaces is detachably held to said surfaces by pins which are integral with and part of the protection material, said pins passing through apertures in said arms and engagable with and retainable by locking apertures in a protection material on an opposide side surface.

5. The lever of claim 4 wherein said locking apertures are contained in protrusions projecting from the protection material disposed in said opposite side surface, said protrusions being disposed in apertures in said arms.

6. The lever of claim 1 wherein at least the opposed side surfaces of the hooking arm have said protection material detachably disposed thereon, and wherein the protection material covers substantially all of said opposed side surfaces of the hooking arm.

7. The lever of claim 6 wherein said protection material is detachably disposed on said opposed side surfaces by cement.

8. The lever of claim 1 wherein the first actuatable arm at the first end thereof comprises a bifurcated portion having bifurcated arms and the first end of the second arm is hingably attached to the bifurcated arms and the protection material disposed on the opposed side surfaces of the second arm lies within said bifurcated arms.

* * * * *